United States Patent [19]

Young

[11] Patent Number: 4,869,209

[45] Date of Patent: Sep. 26, 1989

[54] SOOT CHASER

[75] Inventor: John H. Young, Hayes, Va.

[73] Assignee: Engineering Controls, Inc., St. Louis, Mo.

[21] Appl. No.: 253,089

[22] Filed: Oct. 4, 1988

[51] Int. Cl.[4] ..... F22B 37/18; F22B 37/48

[52] U.S. Cl. ..... 122/379; 122/390; 134/18; 165/95

[58] Field of Search ..... 122/379, 390, 391, 392; 165/95; 134/18

[56] References Cited

U.S. PATENT DOCUMENTS

| | | | |
|---|---|---|---|
| 4,100,887 | 7/1978 | Malmstrone et al. | 122/379 |
| 4,718,376 | 1/1988 | Leroueil et al. | 122/379 X |
| 4,766,952 | 8/1988 | Onodera | 165/95 |

*Primary Examiner*—Edward G. Favors

*Attorney, Agent, or Firm*—Polster, Polster and Lucchesi

[57] ABSTRACT

An automatic programmable cleaning system for heat transfer tubes in an engine exhaust gas waste heat recovery boiler is disclosed. The waste heat is transported as an exhaust gas stream at a water vaporizing temperature through heat transfer tubes in the waste heat recovery boiler. The automatic programmable cleaning system operates on predetermined cycles to inject water into the waste heat exhaust gas stream during the operation of the waste heat recovery boiler in order to vaporize the water injected into the waste heat exhaust gas stream and loosen carbon build-up in the heat transfer tubes. In this way, the loosened carbon and the waste heat gases are exhausted together from the waste heat recovery boiler during cleaning thereof. The method for automatically cleaning a waste heat recovery boiler including repetitive cyclical cleansing of the heat transferred tubes by injecting ans vaporizing water in the waste heat exhaust gas stream during operation of the waste heat recovery boiler is also disclosed.

11 Claims, 1 Drawing Sheet

SOOT CHASER

BACKGROUND OF THE INVENTION

The present invention relates to a waste heat recovery boiler cleaning system, and more particularly, to an automatic programmable system for cleaning engine exhaust gas waste heat recovery boilers, and to a method of automatically cleaning same.

Present systems for cleaning and removing soot or carbon build-up from direct fired boilers include the use of either high pressure steam or air. For the cleaning process, the high pressure steam or air is introduced into the direct fired boilers for removing soot or carbon build-up. In the case of co-generation facilities, where a primary power source, such as a diesel or dual fuel (diesel and/or natural gas) engine emits exhaust waste heat, the waste heat is collected and used by waste heat recovery boilers for hot water heating or steam generation. Quite obviously, while the heat recovered from engine exhaust gas waste heat of the diesel or dual fuel engines can be used quite effectively in waste heat recovery boilers, the soot or carbon build-up can clog up the heat transfer tubes in the waste heat recovery boilers and thereby impede the efficiency and operation of the waste heat recovery boilers.

High pressure steam for cleaning purposes is not normally available for cleaning waste heat recovery boilers, and high pressure air is not very effective. As will be appreciated, the engine exhaust gas waste heat used in the waste heat recovery boilers operates at much lower temperatures than direct fire boilers. As a result, high pressure steam and/or high pressure air cannot normally be used to clean soot or carbon build-up from the heat transfer tubes of waste heat recovery boilers. On the other hand, regular and continuous cleaning of the heat transfer tubes must be performed for high performance and efficient operation of waste heat recovery boilers.

SUMMARY OF THE INVENTION

Among the several objects and advantages of the present invention include:

the provision of a waste heat recovery boiler cleaning system including an automatic programmable cleaning system for heat transfer tubes in an exhaust gas waste heat recovery boiler;

the provision of such a cleaning system which enables the waste heat recovery boiler to operate at desired levels of performance and efficiency;

the provision of such a cleaning system which provides for the injection of regular city water into the waste heat recovery boiler during operation thereof in order to vaporize the water and allow removal of the soot or carbon build-up from the heat transfer tubes for exhaust along with the waste heat from the waste recovery boiler;

the provision of such a cleaning system which provides cyclical and repetitive cleaning of the heat transfer tubes in a waste heat recovery boiler;

the provision of such a cleaning system which includes a temperature override of the cleaning system for interrupting the injection of water into the waste heat exhaust stream if no vaporization of the water is occuring therein;

the provision of a method for automatically cleaning heat transfer tubes in a waste heat recovery boiler including the injection and vaporization of water during the introduction of waste heat exhaust gases along with repetitive cyclical cleansing of the heat transfer tubes in waste heat recovery boilers.

Briefly stated, the present invention includes an automatic programmable cleaning system for heat transfer tubes in engine exhaust gas waste heat recovery boilers. The boilers have a waste heat exhaust inlet connected to heat transfer tubes for transporting the waste heat as an exhaust gas stream at a water vaporizing temperature through the heat transfer tubes to a waste heat exhaust outlet. The automatic programmable cleaning system operates over a predetermined cycle to inject water into the waste heat exhaust gas stream in order to allow the water to be vaporized and loosen carbon build-up in the heat transfer tubes during the operation of the waste heat recovery boiler. In this way, the carbon is exhausted through the waste heat exhaust outlet along with exhaust gases in the waste heat exhaust gas stream.

In addition, the present invention provides a method of automatically cleaning heat transfer tubes in an engine exhaust gas waste heat recovery boiler including heat transfer tubes having a waste heat exhaust inlet and a waste heat exhaust outlet. The procedural steps include: introducing a waste heat exhaust gas stream into the waste heat exhaust inlet through the heat transfer tubes and exhausting same out of the waste heat exhaust outlet. Water is injected into the waste heat exhaust gas stream and vaporized during the operation of the waste heat recovery boiler to loosen carbon build-up within the heat transfer tubes for exhaust out of the waste heat exhaust outlet along with the waste heat exhaust gas stream. Repetitive cyclical cleansing of the heat transfer tubes through predetermined cycles of water injection and related vaporization is provided in order to achieve the automatic cleaning of the heat transfer tubes in the waste heat recovery boiler.

Other objects and advantages will become apparent from the ensuing description.

DESCRIPTION OF THE PREFERRED EMBODIMENT

Figure 1:
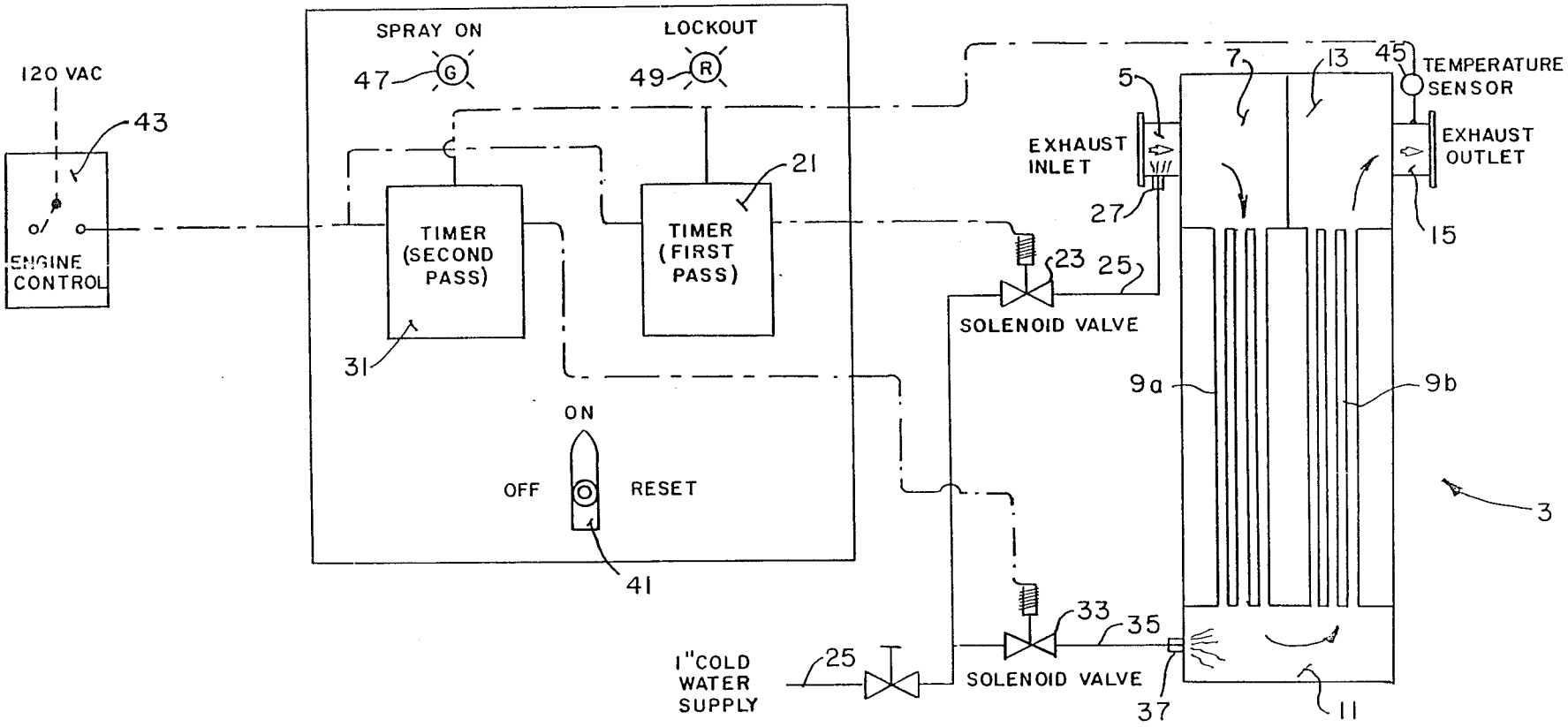
FIG. 1 is an electro/mechanical schematic illustration of the waste heat recovery boiler cleaning system including automatically programmable electrical components for operating the mechanical components to clean the heat transfer tubes in a waste heat recovery boiler.

The drawing is an electro/mechanical illustration of the present invention since the components used in the waste heat recovery boiler cleaning system are conventional; however, the manner in which the components are constructed and used in combination with one another, as well as the method for cleaning, constitute a new and improved cleaning system and method, as will become apparent from the description that follows.

The automatic programmable cleaning system 1 is used for cleaning the waste heat recovery boiler 3. The waste heat recovery boiler 3 includes an exhaust inlet which receives waste heat from a primary power source such as a diesel or dual fuel reciprocating (diesel and/or natural gas) or gas turbine engine commonly employed in co-generation facilities. Typically, dual fuel engines are engines that will operate on straight diesel or natural gas with a small percentage (about 6%) of diesel fuel as a pilot for combustion.

In a typical waste heat recovery boiler, the exhaust waste heat gases represented by the arrows shown in the drawings, are introduced by the exhaust inlet 5 into the enclosed chamber 7 and then are directed downwardly into the heat transfer tubes 9*a* into the compartment at the lower end of the waste heat recovery boiler 1. The stream of waste heat exhaust gases are then introduced back up into the heat transfer tubes 9*b* opposite side of the waste heat recovery boiler 1 and then introduced into the compartment 13 to which the exhaust outlet 15 is connected. The exhaust gases are then removed from the exhaust outlet 15 of the waste heat recovery boiler 1.

While the exhaust gas stream that is transported through the heat transfer tubes 9*a* and 9*b* can be used for heating hot water tubes for hot water heating or steam generation, the diesel fuel oils used in the diesel or dual fuel engines cause a soot or carbon build-up within the heat transfer tubes 9*a*, 9*b* of waste heat recovery boiler 3. In fact, some fuel oils having long carbon chains build up soot or carbon on the heat transfer tubes 9*a*, 9*b* at an even more rapid rate, causing clogging there of, and impeding the desired efficiency and performance of the waste heat recovery boilers 3.

In accordance with important features and teachings of the present invention, an automatic programmable cleaning system 1 is provided for cleaning the heat transfer tubes 9*a*, 9*b* in the waste heat recovery boiler 3. The waste heat gases introduced into the waste heat recovery boiler 3 generally have a temperature of around 900°F., and this is sufficient to heat the heat transfer tubes 9*a*, 9*b* to a temperature for generating hot water heating or steam generation, as may be desired.

Operating at this relatively low temperature, the automatic programmable cleaning system 1 of the present invention includes at least one programmable timer 21 which electrically operates a solenoid valve 23 to open the valve for a predetermined cycle and allow water to be released in a water line 25 in the system. The water line is a conventional one inch cold water supply line which is normally conveniently available. When the solenoid valve 23 is open, the water in the water line is introduced into the exhaust inlet 5 of the waste heat recovery boiler 3 through the nozzle 7 connected to the exhaust inlet 5. Since the waste heat exhaust gas stream, represented by the arrows has a temperature of about 900°F., the water injected by the nozzle 27 into the exhaust inlet 5 will be vaporized and allow a burst of pressure to be introduced into the heat transfer tubes 9*a* to allow the carbon to be exhausted through the waste heat exhaust gas stream as it moves up into the heat transfer tubes 9*b* and out of the exhaust outlet 15. This burst of pressure is created by the sudden introduction of water into the exhaust gas stream to provide a vaporized water/gas stream burst of pressure which is introduced into the heat transfer tubes 9*a*, and then up into the heat transfer tubes 9*b*. Thus, any soot or carbon build-up in the waste heat recovery boiler 3 will be exhausted through the waste heat exhaust outlet 15 along with the exhaust gases in the waste heat exhaust gas stream.

As will be appreciated the timer 21 represents the first pass or introduction of vaporized water into the waste heat recovery boiler 3. In larger waste heat recovery boilers, a second timer may be employed to provide a second pass through the system. In this case, the programmable timer 31 independently operates the solenoid valve 33 which opens up the water line 25 through a water line by-pass 35 for injecting water through the nozzle 37 into the lower compartment 11 of the waste heat recovery boiler 3. The water will also be vaporized and introduced along with the waste heat gases emitted from the heat transfer tubes 9*a* up into the heat transfer tubes 9*b* for thorough cleansing of the heat transfer tubes 9*b*, where necessary. The sudden burst of pressure in the compartment 11, from the water injected through the nozzle 37, may be useful to achieve the same type of cleaning of the heat transfer tubes 9*b* as the sudden burst of pressure is employed for cleaning the heat transfer tubes 9*a*. The size and construction of the waste heat recovery boiler, as well as the type of fuels used, will dictate the employment of one or more programmable timers and related components for use with the waste heat recovery boiler 3.

Conventional solid state programmable timers may be used for the first pass and second pass timers 21, 31 respectively. Typically, this includes activating means such as the on/off/reset switch 41 which electrically couples a power source 43 to latch-in relays in the solid state programmable timers for opening the solenoid valves 23, 33 for a predetermined time cycle. Where the temperature of the waste heat exhaust gas stream is below that required for vaporizing the water, a temperature sensor 45 such as a thermolcouple or the like may be connected to the exhaust outlet 15 of the waste heat recovery boiler to send back an electrical impulse to the timers 21, 31 for interrupting the operation of the timers to shut off the solenoid valve 23, 33 respectively, if no vaporization of the water is occuring during the cleaning operation. Suitable visual indicating lights such as the spray-on light 47 or the lock out/interruption light 49 may be electrically connected in the system to assist the operator. For small waste heat recovery boilers 3, the programmable timers may operate over a short period, such as 4 seconds, to create the burst of pressure through the vaporized water/waste heat gas stream injected into the heat transfer tubes 9*a*, 9*b*. For larger waste heat recovery boilers 3, the programmable timer 21, 31 respectively may be operated over a period of about one minute or more. Of course, the predetermined cycle of operation of each programmable timer, and their repetitive and cyclical operation, with respect to one another, may be varied to suit the particulars required.

The method of automatically cleaning heat transfer tubes 9*a*, 9*b* in an engine exhaust gas waste heat recovery boiler 3 including heat transfer tubes 9*a*, 9*b* having a waste heat exhaust inlet 5 and a waste heat exhaust outlet 15, includes the steps of: introducing a waste heat exhaust gas stream, represented by the arrows in the drawing, into the waste heat exhaust gas inlet 15 through the heat transfer tubes 9*a*, 9*b* and exhausting the waste heat exhaust gases out of the waste heat exhaust outlet 15. Water is injected, through the nozzles 27, 37, into selected areas of the waste heat recovery boiler 3, and the water is vaporized by the heat of the waste heat exhaust gas stream to loosen soot or carbon build-up within the heat transfer tubes 9*a*, 9*b* for exhaust out of the waste heat exhaust outlet 15 along with the waste heat exhaust gas stream. Repetitive and cyclical cleansing of the heat transfer tubes 9*a*, 9*b* through predetermined cycles of water injection and related vaporization of the water within the heat transfer tubes is provided by the programmable timers 21, 31 respectively. The burst of pressure introduced into the waste heat recovery boiler 3 by the vaporized water/waste heat gas stream mixture, during cyclical cleansing, efficiently and thoroughly cleans the heat transfer tubes 9a, 9b. This burst of pressure may be introduced at different times, through the programmable timers 21, 31 respectively, and at different areas such as in the compartments 7 and 11 of the waste heat recovery boiler 3. The temperature of the waste heat exhaust gas stream may be sensed by the temperature sensor 45 adjacent the exhaust outlet 15 to determine if injected water is being vaporized, and if this is not happening, the water injection is interrupted by discontinuing the operation of the programmable timers 21, 31 respectively which causes the solenoid valve 23, 33 respectively to close the respective water line 25, 35 to shut off the water injection.

In view of the above, it will be seen that the several objects of the invention are achieved and other advantageous results are obtained.

As various changes could be made in the above constructions and method without departing from the scope of the invention, it is intended that all matter contained in the above description or shown in the accompanying drawing shall be interpreted as illustrative and not in a limiting sense.

Having thus described the invention, what is claimed and desired to be secured by Letters patent is:

1. An automatic programmable cleaning system for heat transfer tubes in engine exhaust gas waste heat recovery boilers, said boilers having a waste heat exhaust inlet connected to heat transfer tubes for transporting the waste heat as an exhaust gas stream at a water vaporizing temperature through the heat transfer tubes to a waste heat exhaust outlet, and said automatic programmable cleaning system including at least one programmable timer electrically operating a solenoid valve to open the valve for a predetermined cycle and alloy water to be released in a water line in said system, said water line communicating with a nozzle means connected to said heat recovery boiler to allow water to be vaporized as a burst of pressure as it is injected into said waste heat exhaust gas stream during each of said predetermined cycles, whereby water injected into said waste heat exhaust gas stream is vaporized during each of said predetermined cycles as a burst of pressure so as to loosen carbon build-up in said heat transfer tubes and allow the carbon to be exhausted through the waste heat exhaust outlet along with exhaust gases in the waste heat exhaust gas stream.

2. The automatic programmable cleaning system as defined in claim 1 including two programmable timers each independently operating a solenoid valve to open a separate water line communicating with nozzles means connected to said heat recovery boiler, one of said nozzles means being connected to the waste heat exhaust inlet to allow vaporization as a burst of pressure when water is injected into the waste heat exhaust gas stream as it enters the waste heat exhaust inlet, and said other nozzle means being connected to said heat recovery boiler to inject water into said waste heat exhaust stream between the waste heat exhaust inlet and waste heat exhaust outlet of said heat recovery boiler.

3. The automatic programmable cleaning system as defined in claim 2 wherein both said waste heat exhaust inlet and waste heat exhaust outlet are located at an upper end of said heat recovery boiler, said heat recovery boiler having a passageway at a lower end thereof, and said other nozzle means being connected to said heat recovery boiler in communication with said passageway at a lower end of said heat recovery boiler.

4. The automatic programmable cleaning system as defined in claim 1 including low temperature override means associated with said waste heat exhaust outlet for interrupting the injection of water into said waste heat exhaust gas stream if no vaporization of the water is occuring therein.

5. The automatic programmable cleaning system as defined in claim 4 wherein said low temperature override means comprises a thermocouple element positioned in said waste heat exhaust gas stream adjacent to the waste heat exhaust outlet of said heat recovery boiler.

6. The automatic programmable cleaning system as defined in claim 1 wherein said at least one programmable timer includes activating means electrically coupling a power source to latch-in relays for opening said solenoid valve for a predetermined time cycle, and low temperature override means associated with said heat recovery boiler for interrupting the injection of water into said waste heat exhaust gas stream if no vaporization of water is occuring therein.

7. In an engine exhaust gas waste heat recovery boiler having a waste heat exhaust inlet connected to heat transfer tubes for transporting the waste heat as an exhaust gas stream at a water vaporizing temperature through the heat transfer tubes to a waste heat exhaust outlet, wherein the improvement comprises: an automatic programmable cleaning system for said heat transfer tubes including at least one programmable timer electrically operating a solenoid valve to open the valve for a predetermined cycle and allow water to be released in a water line in said system, said water line communicating with a nozzle means connected to said heat recovery boiler to allow water to be vaporized as a burst of pressure as it is injected into said waste heat exhaust gas stream, whereby water injected into said waste heat exhaust gas stream is vaporized and loosens carbon build-up to be exhausted through the waste heat exhaust outlet along with exhaust gases in the waste heat exhaust gas stream.

8. The method of automatically cleaning heat transfer tubes in an engine exhaust gas waste heat recovery boiler including heat transfer tubes having a waste heat exhaust inlet and a waste heat exhaust outlet, comprising the steps of:

introducing a waste heat exhaust gas stream into said waste heat exhaust inlet through said heat transfer tubes and exhausting same out of said waste heat exhaust outlet;

injecting water into said waste heat exhaust gas stream and vaporizing the water to loosen carbon build-up within the heat transfer tubes for exhaust out of the waste heat exhaust outlet along with said waste heat exhaust gas stream; and establishing repetitive cyclical cleansing of said heat transfer tubes through predetermined cycles of water injection and related vaporization of said water as a burst of pressure during each of said predetermined cycles within said heat transfer tubes.

9. The method as defined in claim 8 including the steps of sensing the temperature within said waste heat exhaust gas stream to determine if injected water is being vaporized and interrupting the injection of water into said waste heat exhaust gas stream if no vaporization is occuring.

10. The method as defined in claim 9 including the step of injecting water at different times and in different areas of said waste heat exhaust gas stream.

11. The method as defined in claim 9 wherein the burst of pressure is introduced at different times and in different areas of said waste heat exhaust gas stream.

* * * * *

UNITED STATES PATENT AND TRADEMARK OFFICE

CERTIFICATE OF CORRECTION

PATENT NO. : 4,869,209

DATED : September 26, 1989

INVENTOR(S) : John H. Young

It is certified that error appears in the above-identified patent and that said Letters Patent is hereby corrected as shown below:

Abstract, line 17 is "ans"
Should be -- and --;

Column 3, line 6 is "compartment at"
Should be -- compartment 11 at --; and

Column 6, line 65 is "Claim 9"
Should be -- Claim 8 --.

Signed and Sealed this

Sixth Day of November, 1990

*Attest:*

HARRY F. MANBECK, JR.

*Attesting Officer*

*Commissioner of Patents and Trademarks*